United States Patent [19]

Davis

[11] 4,425,138

[45] Jan. 10, 1984

[54] TWO-CYCLE FUEL COMPOSITIONS CONTAINING AMINO PHENOLS

[75] Inventor: Kirk E. Davis, Euclid, Ohio

[73] Assignee: The Lubrizol Corporation, Wickliffe, Ohio

[21] Appl. No.: 310,696

[22] Filed: Oct. 13, 1981

Related U.S. Application Data

[63] Continuation-in-part of Ser. No. 163,014, Jun. 25, 1980, abandoned, which is a continuation of Ser. No. 622,357, Oct. 14, 1975, abandoned.

[51] Int. Cl.[3] ..... C10L 1/10; C10M 3/26

[52] U.S. Cl. ..... 44/58; 44/75; 252/51.5 R

[58] Field of Search ..... 44/58, 75; 252/47.5, 252/51.5 R; 564/418, 419, 422, 423, 439

[56] References Cited

U.S. PATENT DOCUMENTS

| | | | |
|---|---|---|---|
| 2,065,568 | 12/1936 | Elley et al. | 44/9 |
| 2,367,377 | 1/1945 | Reiff et al. | 252/51 |
| 2,502,436 | 4/1950 | Dawson et al. | 260/575 |
| 2,633,425 | 3/1953 | Thompson | 99/163 |
| 2,868,844 | 1/1959 | Coffield et al. | 260/622 |
| 3,194,839 | 7/1965 | Robinson et al. | 260/575 |
| 3,255,252 | 6/1966 | Gold | 260/570 |
| 3,539,633 | 11/1970 | Piasek et al. | 260/570.5 |
| 3,753,905 | 8/1973 | Souillard et al. | 252/33.4 |
| 3,868,403 | 2/1975 | Becker et al. | 260/471 R |
| 4,025,316 | 5/1977 | Stover | 44/58 |
| 4,320,020 | 3/1982 | Lange | 252/51.5 R |
| 4,320,021 | 3/1982 | Lange | 252/51.5 R |

OTHER PUBLICATIONS

Mazitova et al., *Chem. Abstracts*, 53, 3672e, (1959).
Paushkin et al., *Chem. Abstracts*, 54, 13619h, (1960).

*Primary Examiner*—Andrew Metz
*Attorney, Agent, or Firm*—Roger Y. K. Hsu; J. Walter Adams; Raymond F. Keller

[57] ABSTRACT

Lubricating oils containing at least one amino phenol of the general formula

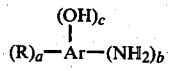

wherein R is a substantially saturated, hydrocarbon-based group of at least about 10 aliphatic carbon atoms, a, b and c are, for example, each 1, 2 or 3, and Ar is an aromatic moiety such as a benzene nucleus, naphthalene nucleus or linked benzene nuclei, are effective in lubricating two-cycle internal combustion engines. Typically such amino phenols for this use are formed by nitration and reduction of alkyl phenols having an alkyl or alkenyl group of at least about 50 carbon atoms.

67 Claims, No Drawings

TWO-CYCLE FUEL COMPOSITIONS CONTAINING AMINO PHENOLS

BACKGROUND OF THE INVENTION (1) Field of the Invention

This invention relates to lubricant compositions containing a major amount of an oil of lubricating viscosity and a minor amount of at least one amino phenol which are useful in two-cycle internal combustion engines. More particularly, it relates to such oils containing amino phenols having at least one hydrocarbon-based group of at least about 10 aliphatic carbon atoms. Since two-cycle engine oils are often combined with fuels before or during use, this invention also relates to two-cycle fuel-lubricant mixtures.

(2) Prior Art

U.S. Pat. No. 2,197,835 describes the formation of metal salts of aromatic amines, said amines being formed by nitration followed by reduction of wax-substituted hydroxy-aromatic hydrocarbons. These metal salts can be incorporated in mineral oils to depress their pour point and increase their viscosity indices.

U.S. Pat. Nos. 2,502,708 and 2,571,092 both disclose the nitration and subsequent hydrogenation to an amine of cardanol. This amino cardanol is said to be useful as an anti-oxidant for mineral oils, fats and petroleum oils. Cardanol, also known as anacardol, is also said to be a mixture of 3-pentadecylphenol, 3-(8′-pentadecenyl)-phenol, 3-(8′:11′-pentadecadienyl)phenol and 3-(8:11:14′-pentadecatrienyl)phenol. Formulae presented in both the '092 and '708 patents as well as the chemical literature (see the Dictionary of Organic Compounds, Vol. 1, Oxford University Press, N.Y., 1965, page 229) show that the $C_{15}$ substituent in cardanol is meta position to the hydroxy group.

U.S. Pat. No. 2,859,251 discloses the alkylation of ortho-, para-, and meta-amino phenols with olefin polymers having from 6 to 18 carbon atoms per molecule in the presence of a catalytic complex formed by mixing hydrogen fluoride with boron trifluoride and an iron group metal flouride. The '251 patent fails to disclose whether the alkyl groups in the product mixture are bonded to a carbon, nitrogen and/or oxygen atom.

(3) General Background

Over the past several decades the use of spark-ignited two-cycle (two-stroke) internal combustion engines including rotary engines such as those of the Wankel type has steadily increased. They are presently found in power lawn mowers and other power-operated garden equipment, power chain saws, pumps, electrical generators, marine outboard engines, snow mobiles and the like.

The increasing use of two-cycle engines coupled with increasing severity of the conditions in which they have operated has led to an increasing demand for oils to adequately lubricate such engines. Among the problems associated with lubrication of two-cycle engines are piston ring sticking, rusting, lubrication failure of connecting rod and main bearings and the general formation on the engine's interior surfaces of carbon and varnish deposits. The formation of varnish is a particularly vexatious problem since the build-up of varnish on piston and cylinder walls is believed to ultimately result in ring sticking which leads to failure of the sealing function of piston rings. Such seal failure causes loss of cylinder compression which is particularly damaging in two-cycle engines because they depend on suction to draw the new fuel charge into the exhausted cylinder. Thus, ring sticking can lead to deterioration in engine performance and unnecessary consumption f fuel and/or lubricant. These additives can also reduce spark plug fouling and engine port plugging problems.

The unique problems and techniques associated with the lubrication of two-cycle engines has led to the recognition by those skilled in the art of two-cycle engine lubricants as a distinct lubricant type. See, for example, U.S. Pat. Nos. 3,085,975, 3,004,837 and 3,753,905.

The invention described herein is directed to alleviation of these problems through the provision of effective additives for two-cycle engine oils and oil-fuel combinations which eliminate or reduce engine varnish deposits and piston ring seal failure.

(4) Objects

Therefore, it is an object of this invention to provide novel lubricants and fuel-lubricant mixtures for two-cycle engines.

It is a further object of this invention to provide novel means for lubricating two-cycle engines.

Other objects will be apparent to those skilled in the art upon review of the present specification.

SUMMARY OF THE INVENTION

This invention comprises a lubricant composition for two-cycle engines comprising major amount by weight of at least one oil of lubricating viscosity and a minor amount by weight of at least one amino phenol of the formula

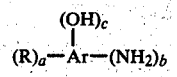

Formula I wherein R is a substantially saturated hydrocarbon-based substituent of at least 10 aliphatic carbon atoms; a, b, and c are each independently an integer of 1 up to three times the number of aromatic nuclei present in Ar with the proviso that the sum of a, b, and c does not exceed the unsatisfied valences of Ar; and Ar is an aromatic moiety having 0 to 3 optional substituents selected from the group consisting of lower alkyl, lower alkoxyl, nitro, halo, or combinations of two or more of said optional substituents; with the proviso that when Ar is a benzene nucleus having only one hydroxyl and one R substituent, the R substituent is ortho or para to said hydroxyl substituent.

The term "phenol" is used in this specification in its art-accepted generic sense to refer to hydroxy-aromatic compounds having at least one hydroxyl group bonded directly to a carbon of an aromatic ring.

Lubricating oil-fuel mixtures for two-cycle engines and methods for lubricating two-cycle engines including Wankel engines are also within the scope of this invention.

The amino phenols used in the two-cycle oils of this invention form no part of this invention but rather are the invention of Richard M. Lange and are claimed by him in copending applications Ser. No. 249,770, filed Apr. 1, 1981, and Ser. No. 253,830, filed Apr. 13, 1981, both of which are assigned to the assignee of the present application.

DESCRIPTION OF THE INVENTION

The Oils of Lubricating Viscosity

The two-cycle engine oil compositions of this invention comprise a major amount of an oil of lubricating viscosity. Typically this viscosity is in the range of about 2.0 to about 150 cst at 98.9° C., more typically in the range of about 5.0 to about 130 cst at 98.9° C.

These oils of lubricating viscosity can be natural or synthetic oils. Mixtures of such oils are also often useful.

Natural oils include mineral lubricating oils such as liquid petroleum oils and solvent-treated or acid-treated mineral lubricating oils of the paraffinic, naphthenic or mixed paraffinic-naphthenic types. Oils of lubricating viscosity derived from coal or shale are also useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, etc.); poly(1-hexenes), poly(1-octenes), poly(1-decenes), etc. and mixtures thereof; alkylbenzenes (e.g., dodecylbenzenes, tetradecylbenzenes, dinonylbenzenes, di-(2-ethylhexyl)-benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Oils made by polymerizing olefins of less than 5 carbon atoms, such as ethylene, propylene, butylenes, isobutene, pentene, and mixtures thereof are typical synthetic polymer oils. Methods of preparing such polymer oils are well known to those skilled in the art as is shown by U.S. Pat. Nos. 2,278,445, 2,301,052, 2,318,719, 2,329,714, 2,345,574 and 2,422,443.

Alkylene oxide polymers (i.e., homopolymers, interpolymers, and derivatives thereof where the terminal hydroxyl groups have been modified by esterification, etherification, etc.) constitute a preferred class of known synthetic lubricating oils for the purposes of this invention, especially for use in combination with alkanol fuels. They are exemplified by the oils prepared through polymerization of ethylene oxide or propylene oxide, the alkyl and aryl ethers of these polyoxyalkylene polymers (e.g., methylpolyisopropylene glycol ether having an average molecular weight of 1000, diphenyl ether of polyethylene glycol having a molecular weight of 500–1000, diethyl ether of polypropylene glycol having a molecular weight of 1000–1500, etc.) or mono- and polycarboxylic esters thereof, for example, the acetic acid esters, mixed $C_3$–$C_8$ fatty acid esters, or the $C_{13}$Oxo acid diester of tetraethylene glycol.

Another suitable class of synthetic lubricating oils comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acid, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, de(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl)silicate, tetra-(4-methyl-hexyl)silicate, tetra-(p-tert-butylphenyl)silicate, hexyl-(4-methyl-2-pentoxy)disiloxane, poly(methyl)siloxanes, poly(methylphenyl)siloxanes, etc.). Other synthetic lubricating oils include liquid esters of phosphorus-containing acids (e.g., tricresyl phosphate, trioctyl phosphate, diethyl ester of decane phosphonic acid, etc.), polymeric tetrahydrofurans and the like.

Unrefined, refined and rerefined oils, either natural or synthetic (as well as mixtures of two or more of any of these) of the type disclosed hereinabove can be used in the lubricant compositions of the present invention. Unrefined oils are those obtained directly from a natrual or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those of skill in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

The Amino Phenols: The Aromatic Moiety, Ar

The aromatic moiety, Ar, can be a single aromatic nucleus such as a benzene nucleus, a pyridine nucleus, a thiophene nucleus, a 1,2,3,4-tetrahydronaphthalene nucleus, etc., or a polynuclear aromatic moiety. Such polynuclear moieties can be of the fused type; that is, wherein at least two aromatic nuclei are fused at two points to another nucleus such as found in naphthalene, anthracene, the azanaphthalenes, etc. Such polynuclear aromatic moieties also can be of the linked type wherein at least two nuclei (either mono or polynuclear) are linked through bridging linkages to each other. Such bridging linkages can be chosen from the group consisting of carbon-to-carbon single bonds, ether linkages, keto linkages, sulfide linkages, polysulfide linkages of 2 to 6 sulfur atoms, sulfinyl linkages, sulfonyl linkages, methylene linkages, alkylene linkages, di-(lower alkyl)-methylene linkages, lower alkylene ether linkages, alkylene keto linkages, lower alkylene sulfur linkages, lower alkylene polysulfide linkages of 2 to 6 carbon atoms, amino linkages, polyamino linkages and mixtures of such divalent bridging linkages. In certain instances, more than one bridging linkage can be present in Ar between aromatic nuclei. For example, a fluorine nucleus has two benzene nuclei linked by both a methylene linkage and a covalent bond. Such a nucleus may be considered to have 3 nuclei but only two of them are aromatic. Normally, Ar will contain only carbon atoms in the aromatic nuclei per se.

The number of aromatic nuclei, fused, linked or both, in Ar can play a role in determining the values of a, b and c in Formula I. For example, when Ar contains a single aromatic nucleus, a, b, and c are each independently 1 to 3. When Ar contains 2 aromatic nuclei, a, b and c can each be an integer of 1 to 6 that is, from 1 up to three times the number of aromatic nuclei present (e.g., in naphthalene, 2 nuclei). With a trinuclear Ar moiety, a, b and c can again each be an integer of 1 to 9. Thus, for example, when Ar is a biphenyl moiety, a, b and c can each independently be an integer of 1 to 6. The values of a, b and c are obviously limited by the fact that their sum cannot exceed the total unsatisfied valences of Ar.

The single ring aromatic nucleus which can be the Ar moiety can be represented by the general formula $$ar(Q)_m$$

wherein ar represents a single ring aromatic nucleus (e.g., benzene) of 4 to 10 carbons, each Q independently represents a lower alkyl group, lower alkoxyl group, nitro group, or halogen atom, and m is 0 to 3. As used in this specification and appended claims, "lower" refers to groups having 7 or less carbon atoms such as lower alkyl and lower alkoxyl groups. Halogen atoms include fluorine, chlorine, bromine and iodine atoms; usually, the halogen atoms are fluorine and chlorine atoms.

Specific examples of such single ring Ar moieties are the following:

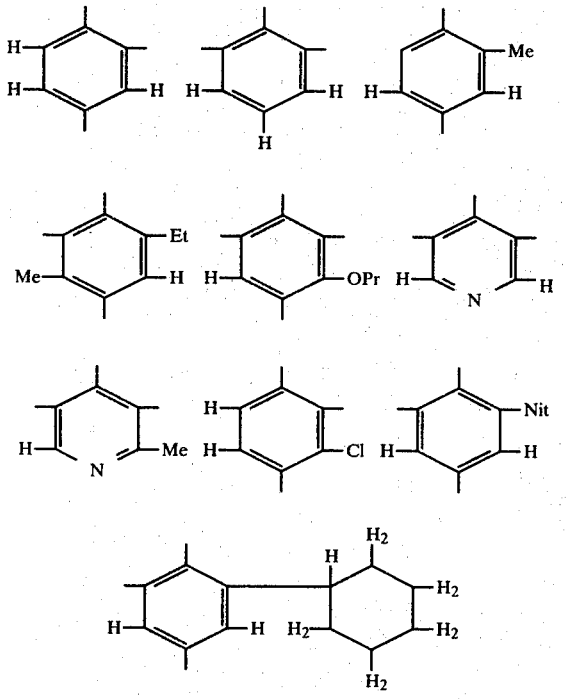

-continued

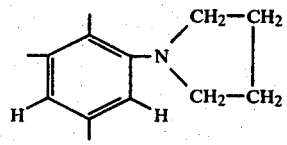

etc. wherein Me is methyl, Et is ethyl, Pr is n-propyl, and Nit is nitro.

When Ar is a polynuclear fused-ring aromatic moiety, it can be represented by the general formula $$ar\left(ar\right)_{m'} \quad (Q)_{mm'}$$

wherein ar, Q and m are as defined hereinabove, m' is 1 to 4 and ⊃ represent a pair of fusing bonds fusing two rings so as to make two carbon atoms part of the rings of each of two adjacent rings. Specific examples of fused ring aromatic moieties Ar are:

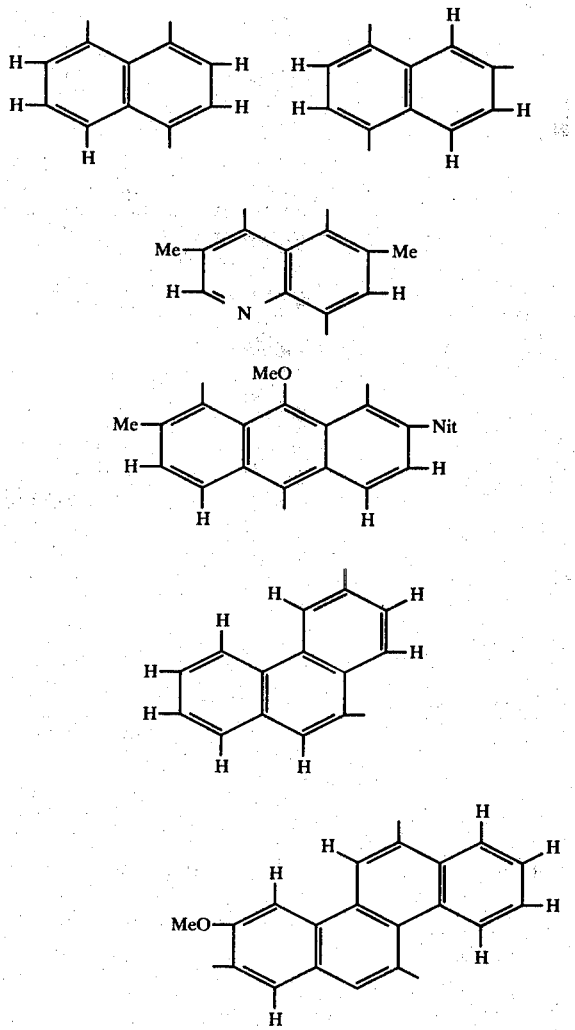

etc.

When the aromatic moiety Ar is a linked polynuclear aromatic moiety it can be represented by the general formula $$ar\left(Lng\text{-}ar\right)_{m}(Q)_{mw}$$

wherein w is an integer of 1 to about 20, ar is as described above with the proviso that there are at least 3 unsatisfied (i.e., free) valences in the total of ar groups, Q and m are as defined hereinbefore, and each Lng is a bridging linkage individually chosen from the group consisting of carbon-to-carbon single bonds, ether linkages (e.g., —O—), keto linkages $$\text{(e.g., } -\overset{\overset{\displaystyle O}{\|}}{C}-\text{),}$$

sulfide linkages (e.g., —S—), polysulfide linkages of 2 to 6 sulfur linkages (e.g., $—S_{2-6}—$), sulfinyl linkages (e.g., —S(O)—), sulfonyl linkages (e.g., $—S(O)_2—$), lower alkylene linkages (e.g., $—CH_2—$, $—CH_2—CH_2—$, $$-CH-\underset{\displaystyle R^\circ}{\underset{|}{CH}}-,$$

etc.), di(lower alkyl)-methylene linkages (e.g., $—CR_2^\circ—$), lower alkylene ether linkages (e.g., $—CH_2O—$, $—CH_2O—CH_2—$, $—CH_2—CH_2O—$, $—CH_2CH_2OCH_2CH_2—$, $$-CH_2\underset{\displaystyle R^\circ}{\underset{|}{C}}HO\underset{\displaystyle R^\circ}{\underset{|}{C}}H_2-,\ -CH_2\underset{\displaystyle R^\circ}{\underset{|}{C}}HO\underset{\displaystyle R^\circ}{\underset{|}{C}}HCH_2-,$$

etc.), lower alkylene keto linkages $$\text{(e.g., } -CH_2\overset{\overset{\displaystyle O}{\|}}{C}-,\ -CH_2\overset{\overset{\displaystyle O}{\|}}{C}CH_2-\text{),}$$

lower alkylene sulfide linkages (e.g., wherein one or more —O—'s in the lower alkylene ether linkages is replaced with an —S— atom), lower alkylene polysulfide linkages (e.g., wherein one or more —O—'s is replaced with a $—S_{2-6}$ group), amino linkages (e.g., $$-\underset{\displaystyle H}{\underset{|}{N}}-,\ -\underset{\displaystyle R^\circ}{\underset{|}{N}}-,\ -CH_2\underset{|}{N}-,\ -CH_2\underset{|}{N}CH_2-,\ -alk-\underset{|}{N}-,$$

where alk is lower alkylene, etc.), polyamino linkages $$\text{(e.g., } -\underset{|}{N}(alk\underset{|}{N})_{1-10},$$

where the unsatisfied free N valences are taken up with H atoms or R° groups), and mixtures of such bridging linkages (each R° being a lower alkyl group).

Specific examples of Ar when it is a linked polynuclear aromatic moiety include:

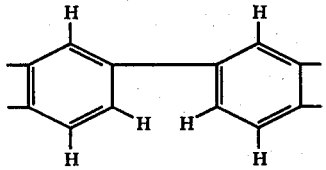

-continued

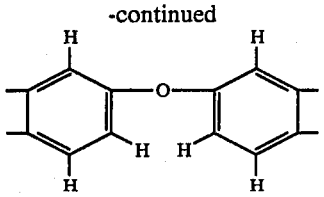

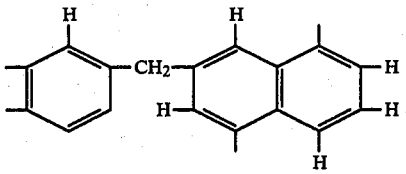

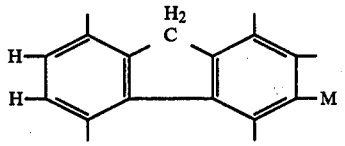

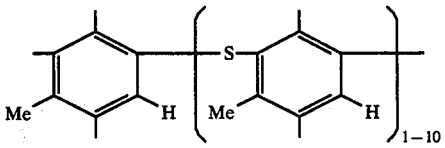

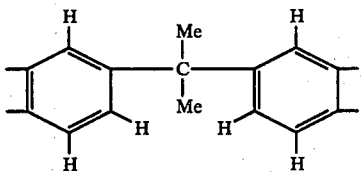

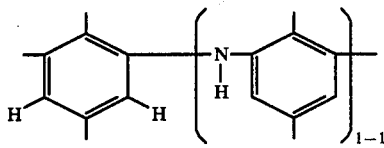

Usually all these Ar moieties are unsubstituted except for the R, —OH and $—NH_2$ groups (and any bridging groups).

For such reasons as cost, availability, performance, etc., the Ar moiety is normally a benzene nucleus, lower alkylene bridged benzene nucleus, or a naphthalene nucleus. Thus, a typical Ar moiety is a benzene or naphthalene nucleus having 3 to 5 unsatisfied valences, so that one or two of said valences may be satisfied by a hydroxyl group with the remaining unsatisfied valences being, insofar as possible, either ortho or para to a hydroxyl group. Preferably, Ar is a benzene nucleus having 3 to 4 unsatisfied valences so that one can be satisfied by a hydroxyl group with the remaining 2 or 3 being either ortho or para to the hydroxyl group.

The Substantially Saturated Hydrocarbon-based Group R

The amino phenols used in the two-cycle oils of the present invention contain, directly bonded to the aromatic moiety Ar, a substantially saturated monovalent hydrocarbon-based group R of at least about 10 aliphatic carbon atoms. This R group can have up to about 400 aliphatic carbon atoms. More than one such group can be present, but usually, no more than 2 or 3 such groups are present for each aromatic nucleus in the aromatic moiety Ar. The total number of R groups present is indicated by the value for "a" in Formula I. Usually, the hydrocarbon-based group has at least about 30, more typically, at least about 50 aliphatic carbon atoms and up to about 400, more typically, up to about 300 aliphatic carbon atoms.

Generally, the hydrocarbon-based groups R are made from homo- or interpolymers (e.g., copolymers, terpolymers) of mono- and di-olefins having 2 to 10 carbon atoms, such as ethylene, propylene, butene-1, isobutene, butadiene, isoprene, 1-hexene, 1-octene, etc. Typically, these olefins are 1-monoolefins. The R groups can also be derived from the halogenated (e.g., chlorinated or brominated) analogs of such homo- or interpolymers. The R groups can, however, be made from other sources, such as monomeric high molecular weight alkenes (e.g., 1-tetracontene) and chlorinated analogs and hydrochlorinated analogs thereof, aliphatic petroleum fractions, particularly paraffin waxes and cracked and chlorinated analogs and hydrochlorinated analogs thereof, white oils, synthetic alkenes such as those produced by the Ziegler-Natta process (e.g., poly-(ethylene) greases) and other sources known to those skilled in the art. Any unsaturation in the R groups may be reduced or eliminated by hydrogenation according to procedures known in the art before the nitration step described hereafter.

As used herein, the term "hydrocarbon-based" denotes a group having a carbon atom directly attached to the remainder of the molecule and having a predominantly hydrocarbon character within the context of this invention. Therefore, hydrocarbon-based groups can contain up to one non-hydrocarbon radical for every ten carbon atoms provided this non-hydrocarbon radical does not significantly alter the predominantly hydrocarbon character of the group. Those skilled in the art will be aware of such radicals, which include, for example, hydroxyl, halo (especially chloro and fluoro), alkoxyl, alkyl mercapto, alkyl sulfoxy, etc. Usually, however, the hydrocarbon-based groups R are purely hydrocarbyl and contain no such non-hydrocarbyl radicals.

The hydrocarbon-based groups R are substantially saturated, that is, they contain no more than one carbon-to-carbon unsaturated bond for every ten carbon-to-carbon single bond present. Usually, they contain no more than one carbon-to-carbon non-aromatic unsaturated bond for every 50 carbon-to-carbon bonds present.

The hydrocarbon-based groups of the amino phenols used in the two-cycle oils of this invention are also substantially aliphatic in nature, that is, they contain no more than one non-aliphatic moiety (cycloalkyl, cycloalkenyl or aromatic) group of six or less carbon atoms for every ten carbon atoms in the R group. Usually, however, the R groups contain no more than one such non-aliphatic group for every fifty carbon atoms, and in many cases, they contain no such non-aliphatic groups at all; that is, the typical R groups are purely aliphatic. Typically, these purely aliphatic R groups are alkyl or alkenyl groups.

Specific examples of the substantially saturated hydrocarbon-based R groups are the following:

- a tetra(propylene) group
- a tri(isobutene) group
- a tetracontanyl group
- a henpentacontanyl group
- a mixture of poly(ethylene/propylene) groups of about 35 to about 70 carbon atoms
- a mixture of the oxidatively or mechanically degraded poly(ethylene/propylene) groups of about 35 to about 70 carbon atoms
- a mixture of poly(propylene/1-hexene) groups of about 80 to about 150 carbon atoms
- a mixture of poly(isobutene) groups having between 20 and 32 carbon atoms
- a mixture of poly(isobutene) groups having an average of 50 to 75 carbon atoms a preferred source of the group R are poly(isobutene)s obtained by polymerization of a $C_4$ refinery stream having a butene content of 35 to 75 weight percent and isobutene content of 30 to 60 weight percent in the presence of a Lewis acid catalyst such as aluminum trichloride or boron trifluoride. These polybutenes contain predominantly (greater than 80% of total repeating units) isobutene repeating units of the configuration

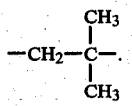

The attachment of the hydrocarbon-based group R to the aromatic moiety Ar of the amino phenols used in the two-cycle oils of this invention can be accomplished by a number of techniques well known to those skilled in the art. One particularly suitable technique in the Friedel-Crafts reaction, wherein an olefin (e.g., a polymer containing an olefinic bond), or halogenated or hydrohalogenated analog thereof, is reacted with a phenol. The reaction occurs in the presence of a Lewis acid catalyst (e.g., boron trifluoride and its complexes with ethers, phenols, hydrogen fluoride, etc., aluminum chloride, aluminum bromide, zinc dichloride, etc.). Methods and conditions for carrying out such reactions are well known to those skilled in the art. See, for example, the discussion in the article entitled, "Alkylation of Phenols" in Kirk-Othmer "Encyclopedia of Chemical Technology", Second Edition, Vol. 1, pages 894–895, Interscience Publishers, a division of John Wiley and Company, N.Y., 1963. Other equally well known appropriate and convenient techniques for attaching the hydrocarbon-based group R to the aromatic moiety Ar will occur readily to those skilled in the art.

As will be appreciated from inspection of Formula I, the amino phenols used in the two-cycle oils of this invention contain at least one of each of the following substituents: a hydroxyl group, a R group as defined above, and a primary amine group, $—NH_2$. Each of the foregoing groups must be attached to a carbon atom which is a part of an aromatic nucleus in the Ar moiety. They need not, however, each be attached to the same aromatic ring if more than one aromatic nucleus is present in the Ar moiety.

In a preferred embodiment, the amino phenols used in the two-cycle oils of this invention contain one each of the foregoing substituents and but a single aromatic ring, most preferably benzene. This preferred class of amino phenols can be represented by the formula

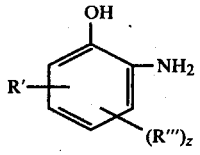

wherein the R' group is a hydrocarbon-based group of about 30 to about 400 aliphatic carbon atoms located ortho or para to the hydroxyl group, R''' is a lower alkyl, lower alkoxyl, nitro group or halogen atom and z is 0 or 1. Usually z is 0 and R' is substantially saturated, purely aliphatic group. Often it is an alkyl or alkenyl group para to the —OH substituent.

In a still more preferred embodiment of this invention, the amino phenol is of the formula

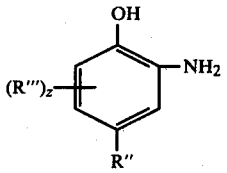

wherein R'' is derived from homopolymerized or interpolymerized $C_{2-10}$ 1-olefins and has an average of from about 30 to about 300 aliphatic carbon atoms and R''' and z are as defined above. Usually R'' is derived from ethylene, propylene, butylene and mixtures thereof. Typically, it is derived from polymerized isobutene. Often R'' has at least about 50 aliphatic carbon atoms and z is 0.

The amino phenols used in the two-cycle oils of the present invention can be prepared by a number of snythetic routes. These routes can vary in the type reactions used and the sequence in which they are employed. For example, an aromatic hydrocarbon, such as benzene, can be alkylated with alkylating agent such as polymeric olefin to form an alkylated aromatic intermediate. This intermediate can then be nitrated, for example, to form polynitro intermediate. The polynitro intermediate can, in turn, be reduced to a diamine, which can then be diazotized and reacted with water to convert one of the amino groups into a hydroxyl group and provide the desired amino phenol. Alternatively, one of the nitro groups in the polynitro intermediate can be converted to a hydroxyl group through fusion with caustic to provide a hydroxy-nitro alkylated aromatic which can then be reduced to provide the desired amino phenol.

Another useful route to amino phenols involves the alkylation of a phenol with an olefinic alkylating agent to form an alkylated phenol. This alkylated phenol can then be nitrated to form a mono- or polynitro phenol which can be converted to the desired amino phenols by reducing at least a portion of the nitro groups in the intermediate to amino groups.

Techniques for alkylating phenols are well known to those skilled in the art as the above-noted article in Kirk-Othmer "Encyclopedia of Chemical Technology" demonstrates. Techniques for nitrating phenols are also known. See, for example, in Kirk-Othmer "Encyclopedia of Chemical Technology", Second Edition, Vol. 13, the article entitled "Nitrophenols", page 888 et seq., as well as the treatises "Aromatic Substitution; Nitration and Halogenation" by P. B. D. De La Mare and J. H. Ridd, N.Y., Academic Press, 1959; "Nitration and Aromatic Reactivity" by J. G. Hogget, London, Cambridge University Press, 1961; and "The Chemistry of the Nitro and Nitroso Groups", Henry Feuer, Editor, Interscience Publishers, N.Y., 1969.

Aromatic hydroxy compounds can be nitrated with nitric acid, mixtures of nitric acid with acids such as sulfuric acid or boron trifluoride, nitrogen tetraoxide, nitronium tetrafluoroborates and acyl nitrates. Generally, nitric acid of a concentration of, for example, about 60–90% is a convenient nitrating reagent. Substantially inert liquid diluents and solvents such as acetic or butyric acid can aid in carrying out the reaction by improving reagent contact.

Conditions and concentrations for nitrating hydroxy aromatic compounds are also well known in the art. For example, the reaction can be carried out at temperatures of about −15° C. to about 150° C. Usually nitration is conveniently carried out between about 25°–75° C.

Generally, depending on the particular nitrating agent about 0.5–4 moles of nitrating agent is used for every mole of aromatic nucleus present in the hydroxy aromatic intermediate to be nitrated. If more than one aromatic nucleus is present in the Ar moiety, the amount of nitrating agent can be increased proportionately according to the number of such nuclei present. For example, a mole of naphthalene-based aromatic intermediate has, for purposes of this invention, the equivalent of two "single ring" aromatic nuclei so that about 1–4 moles of nitrating agent would generally be used. When nitric acid is used as a nitrating agent usually about 1.0 to about 3.0 moles per mole of aromatic nucleus is used. Up to about a 5 molar excess of nitrating agent (per "single ring" aromatic nucleus) may be used when it is desired to drive the reaction forward or carry it out rapidly.

Nitration of a hydroxy aromatic intermediate generally takes 0.25 to 24 hours depending on such variables as temperature, the amount, type and quality of intermediate and nitrating agent, though it may be convenient to react the nitration mixture for longer periods, such as 96 hours.

Reduction of aromatic nitro compounds to the corresponding amines is also well known. See, for example, the article entitled "Amination by Reduction" in Kirk-Othmer "Encyclopedia of Chemical Technology", Second Edition, Vol. 2, pages 76–99. Generally, such reductions can be carried out with, for example, hydrogen, carbon monoxide or hydrazine, (or mixtures of same) in the presence of metallic catalysts such as palladium, platinum and its oxides, nickel, copper chromite, etc. Co-catalysts such as alkali or alkaline earth metal hydroxides or amines (including amino phenols) can be used in these catalyzed reductions.

Reduction can also be accomplished through the use of reducing metals in the presence of acids, such as hydrochloric acid. Typical reducing metals are zinc, iron and tin; salts of these metals can also be used.

Nitro groups can also be reduced in the Zinin reaction, which is discussed in "Organic Reactions", Vol. 20, John Wiley & Sons, N.Y., 1973, page 455 et seq. Generally, the Zinin reaction involves reduction of a nitro group with divalent negative sulfur compounds, such as alkali metal sulfides, polysulfides and hydrosulfides.

The nitro groups can be reduced by electrolytic action; see, for example, the "Amination by Reduction" article, referred to above.

Typically amino phenols are obtained by reduction of nitro phenols with hydrogen in the presence of a metallic catalyst such as discussed above. This reduction is generally carried out at temperatures of about 15°-250° C., typically, about 50°-150° C., and pressures of about 0-2000 psig, typically, about 50-250 psig. The reaction time for reduction usually varies between about 0.5-50 hours. Substantially inert liquid diluents and solvents, such as ethanol, cyclohexane, etc., can be used to facilitate the reaction. The amino phenol product is obtained by well-known techniques such as distillation, filtration, extraction, and so forth.

The reduction is carried out until at least about 50%, usually about 80%, of the total nitro groups in the nitro intermediate mixture, are converted to amino groups. The typical route to amino phenols just described can be summarized as (I) nitrating with at least one nitrating agent at least one compound of the formula

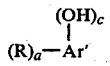

wherein R is a substantially saturated hydrocarbon-based group of at least 10 aliphatic carbon atoms; a and c are each independently an integer of 1 up to three times the number of aromatic nuclei present in Ar with the proviso that the sum of a, b and c does not exceed the unsatisfied valences of Ar'; and Ar' is an aromatic moiety having 0 to 3 optional substituents selected from the group consisting of lower alkyl, lower alkoxyl, nitro, and halo, or combinations of two or more optional substituents, with the provisos that (a) Ar' has at least one hydrogen atom directly bonded to a carbon atom which is part of an aromatic nucleus, and (b) when Ar' is a benzene having only one hydroxyl and one R substituent, the R substituent is ortho or para to said hydroxyl substituent, to form a first reaction mixture containing a nitro intermediate, and (II) reducing at least about 50% of the total nitro groups in said first reaction mixture to amino groups.

Usually this means reducing at least about 50% of the nitro groups to amino groups in a compound or mixture of compounds of the formula

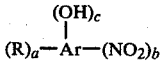

wherein R is a substantially saturated hydrocarbon-based substituent of at least 10 aliphatic carbon atoms; a, b and c are each independently an integer of 1 up to three times the number of aromatic nuclei present in Ar with the proviso that the sum of a, b and c does not exceed the unsatisfied valences of Ar; and Ar is an aromatic moiety having 0 to 3 optional substituents selected from the group consisting of lower alkyl, lower alkoxyl, halo, or combinations of two or more of said optional substituents; with the proviso that when Ar is a benzene nucleus having only one hydroxyl and one R substituent, the R substituent is ortho or para to said hydroxyl substituent.

The following examples describe exemplary preparations of typical amino phenols for use in the two-cycle engine oils of this invention. As will be readily apparent to those skilled in the art, amino phenols prepared by other techniques can also be used. All parts and percentages are by weight, and all temperatures are in degrees Celsius (°C.), in these examples and elsewhere in this specification, unless expressly stated to the contrary.

EXAMPLE 1A

An alkylated phenol is prepared by reacting phenol with polyisobutene having a number average molecular weight of approximately 1000 (vapor phase osmometry) in the presence of a boron trifluoride phenol complex catalyst. Stripping of the product thus formed first to 230°/760 torr (vapor temperature) and then to 205° vapor temperature/50 torr provides purified alkylated phenol.

To a mixture of 265 parts of purified alkyl phenol, 176 parts blend oil and 42 parts of a petroleum naphtha having a boiling point of approximately 20° is added slowly to a mixture of 18.4 parts of concentrated nitric acid (69-70%) and 35 parts of water. The reaction mixture is stirred for 3 hours at about 30°-45°, stripped to 120°/20 torr and filtered to provide an oil solution of the desired nitro phenol intermediate.

EXAMPLE 1B

A mixture of 1,500 parts of the product solution of 1A, 642 parts of 2-propanol and 7.5 parts of nickel on kieselguhr catalyst is charged to an autoclave under a nitrogen atmosphere. After purging and evacuation with nitrogen 3 times, the autoclave is pressured to 100 psig with hydrogen and stirring is begun. The reaction mixture is held at 96° C. for a total of 14.5 hours while a total of 1.66 moles of hydrogen is fed to it. After purging with nitrogen and evaucuating 3 times the reaction mixture is filtered and the filtrate stripped to 120°/18 torr. Filtration provides the desired product in an oil solution containing 0.54% nitrogen.

EXAMPLE 2A

To a mixture of 400 parts of polyisobutene-substituted phenol (wherein the polyisobutene substituent contains approximately 100 carbon atoms), 125 parts of textile spirits and 266 parts of a diluent mineral oil at 28° is slowly added 22.83 parts of nitric acid (70%) in 50 parts of water over a period of 0.33 hour. The mixture is stirred at 28°-34° for 2 hours and stripped to 158°/30 torr, filtration provides an oil solution (40%) of the desired intermediate having a nitrogen content of 0.88%.

EXAMPLE 2B

A mixture of 93 parts of the product solution of Example 2A and 93 parts of a mixture of toluene and 2-propanol (50/50 by weight) is charged to an appropriately sized hydrogenation vessel. The mixture is degassed and nitrogen-purged; 0.31 part of a commercial platinum oxide catalyst (86.4% $PtO_2$) is added. The reaction vessel is pressured to 57 psig and held at 50°-60° for 21 hours. A total of 0.6 mole of hydrogen is fed to the reaction vessel. The reaction mixture is then filtered and the filtrate stripped to yield the desired product in an oil solution containing 0.44% nitrogen.

EXAMPLE 3A

A mixture of 2,160 parts of the polyisobutene-substituted phenol of Example 2A and 1,440 parts of a diluent mineral oil is heated to 60°. Then 25 parts of paraformaldehyde is added to the mixture followed by 15 parts of aqueous hydrochloric acid. The mixture is heated to 115° for 1 hour. After storage for 16 hours at room temperature the reaction mixture is heated to 160° for 1 hour while 20 parts of distillate are removed. Stripping of the reaction mixture to 160°/15 torr provides an oil solution of the desired methylene linked polyisobutene-substituted phenol.

EXAMPLE 3B

To 2,406 parts of the oil solution described in Example 3A and 600 parts of textile spirits is added 90 parts nitric acid (70%) over 1.5 hours. The reaction mixture is stirred for 1.5 hours, stored for 63 hours at room temperature and then heated for 8 hours at 90°. Stripping to 160°/18 torr provides an oil solution of the desired nitrated intermediate containing 0.79% nitrogen.

EXAMPLE 3C

A mixture of 800 parts of the oil solution of Example 3B and 720 parts of a toluene/2-propanol mixture (60/40 by weight) is charged to an autoclave. After nitrogen purging, 4 parts of nickel on kieselguhr catalyst is added. Nitrogen purging is repeated 3 times and the autoclave pressured with hydrogen to 60 psig at 25°. The reaction temperature is slowly increased to 96° and the pressure maintained at 100 psig for 5.5 hours. The autoclave is then opened and an additional 4 parts of nickel of kieselguhr catalyst added. The autoclave is repressured to 100 psig hydrogen and held at 96° and 100 psig for 6 hours. The autoclave is cooled and reopened; and additional 0.8 part of platinum oxide catalyst added. The autoclave is then repressured to 90 psig with hydrogen and kept at this pressure for 8 more hours. The reaction mixture is filtered and stripped to 150°/18 torr to provide an oil solution of the product having a nitrogen content of 0.41%.

EXAMPLE 4A

A mixture of 1,962 parts of the polyisobutene-substituted phenol of Example 1A, 39.5 parts of paraformaldehyde, 15 parts of aqueous hydrochloric acid and 1,372 parts of diluent mineral oil is heated for 7 hours at 115°. The reaction temperature is then increased to 160°–165° and held there for an additional 7 hours. Four hundred parts of textile spirits is added to the mixture and it is cooled to 30°. then 136.95 parts of nitric acid (70%) in 140 parts of water is slowly added. The reaction mixture is stirred for 1.5 hours at 30°–35° and then stripped to 170°/28 torr to provide an oil solution of the intermediate which is clarified by filtration.

EXAMPLE 4B

Ninety-six parts of the oil solution described in Example 4A and 96 parts of a toluene/2-propanol mixture (50/50 by weight) is charged to an appropriately sized hydrogenation vessel. After nitrogen purging 0.32 part of platinum oxide catalyst is added. After again purging the reaction vessel, it was pressured to 57 psig at 25° with hydrogen. The hydrogen pressure is kept between 57 and 50 psig for 60 hours while reaction mixture is heated to 50° to 60°. The resultant reaction mixture is filtered and stripped to provide an oil solution of the product having a nitrogen content of 0.353%.

EXAMPLE 5A

To a mixture of 654 parts of the polyisobutene substituted phenol of Example 1A and 654 parts of isobutyric acid at 27° to 31°, is added 90 parts of 16 molar nitric acid over a period of 0.5 hour. The reaction mixture is held at 50° for 3 hours and then stored at room temperature for 63 hours. Stripping to 160°/26 torr and filtration through filter aid provides the desired nitro intermediate which has a nitrogen content of 1.8%.

EXAMPLE 5B

The nitro product of Example 5A is hydrogenated using a nickel on kieselguhr catalyst following essentially the same procedure described in Example 1B.

EXAMPLE 6A

A mixture of 4,578 parts of the polyisobutene-substituted phenol of Example 1A, 3,052 parts of diluent mineral oil and 725 parts of textile spirits is heated to 60° to achieve homogenity. After cooling to 30°, 320 parts of 16 molar nitric acid in 600 parts of water is added to the mixture. Cooling is necessary to keep the mixture below 40°. After stirring the reaction mixture for an additional 2 hours, 3,710 parts is transferred to a second reaction vessel. This 3,710 parts is treated with an additional 128 parts of 16 molar nitric acid in 130 parts of water at 25°–30°. The reaction mixture is stirred for 1.5 hours and then stripped to 220°/30 torr. Filtration provides an oil solution of the intermediate.

EXAMPLE 6B

The oil solution of the product formed in Example 6A is hydrogenated using a platinum oxide catalyst in substantially the same fashion as described in Example 1B.

EXAMPLE 7

A mixture of 543 parts of a dinitro $C_{25}$ alkylated phenol (prepared in essentially the same manner as described in Example 6A), 543 parts of isopropanol and 200 parts of toluene is treated at 19° C. with a total of 42 parts of gaseous ammonia over a 0.75 hour period. The reaction mixture is then treated with 147 parts of gaseous $H_2S$. Both the ammonia and hydrogen sulfide treatment are carried out by introducing the gas into the stirred mixture under its surface. Ammonia treatment is repeated with 82 parts of gaseous ammonia followed by a final treatment with 102 parts of hydrogen sulfide. Stripping of the reaction mixture to 40°/60 torr yields a residue which is combined with 161 parts of diluent oil and stripped again to 70° C./18 torr. An additional 161 parts of diluent oil and 35 parts of filter aid are added; filtration of this mixture yields a viscous filtrate which is a 40% oil solution of the diamino phenol.

The nitrations in examples 8–14 are carried out in essentially the same manner described in Example 1A, using the hydroxy aromatic compounds and amounts of nitric acid indicated in Table A. Reduction of the nitro intermediates in these examples is carried out using the technique described in the examples indicated in Table A.

TABLE A

| | HYDROXY AROMATIC COMPOUND | | | REDUCTION |
|---|---|---|---|---|
| EXAMPLE | Name | Mol. Wt.[1] | MOLES $HNO_3$[2] | TECHNIQUE[3] |
| 8 | 2,2'-dipoly(isobutene)yl-4,4'-dihydroxybiphenyl | 2500 | 2.2 | 1B |

TABLE A-continued

| EXAMPLE | HYDROXY AROMATIC COMPOUND Name | Mol. Wt.[1] | MOLES $HNO_3$[2] | REDUCTION TECHNIQUE[3] |
|---|---|---|---|---|
| 9 | 8-hydroxy-?-poly(propene)yl-1-azanaphthalene | 900 | 1.0 | 7 |
| 10 | 4-poly(isobutene)yl-1-naphthol | 1700 | 1.1 | 1B |
| 11 | 2-poly(propene/butene-1)yl-4,4'-isopropylidene-bisphenol[4] | 3200 | 2.4 | 1B |
| 12 | 4-tetra(propene)yl-2-hydroxyanthracene | — | 1.0 | 7 |
| 13 | 4-octadecyl-1,3-dihydrpxybenzene | — | 2.2 | 1B |
| 14 | 4-poly(isobutene)-3-hydroxypyridine | 1300 | 1.0 | 7 |

[1]Number average molecular weight by vapor phase osmometry.
[2]Moles of $HNO_3$ per mole of hydroxy acromatic compound
[3]I.e., essentially the same technique described in the indicated example
[4]The mole ratio of propene to butene-1 in the substituent is 2:3

In general, the two-cycle engine lubricating oil compositions of this invention contain about 98 to about 55% oil or mixture of oils of lubricating viscosity. Typical compositions contain about 90 to about 70% oil. The presently preferred oils are mineral oils and mineral oil-synthetic polymer and/or ester oil mixtures. Polybutenes of molecular weights of about 250 to about 1,000 (as measured by vapor phase osmometry) and fatty acid ester oils of polyols such as pentaerythritol and trimethylol propane are typical useful synthetic oils.

These oil compositions contain about 2 to about 30% typically about 5 to about 20%, of at least one amino phenol as described hereinabove. Other additives such as auxiliary detergents and dispersants of the ash-producing or ashless type, anti-oxidants, coupling agents, pour point depressing agents, extreme pressure agents, color stabilizers and anti-foam agents can also be present.

Detergent-dispersants of ashless types and ash-producing metallic types are used to control piston ring sticking and promote general engine cleanliness. The heavier duty two-cycle lubricants require the use of suitable ashless dispersants because of the proneness of the reference engine to deposit induced preignition. Other formulations use calcium, barium or magnesium sulfonates either singly, in combination with one another, or in combination with ashless dispersants. Antioxidants can be included to promote lubricant thermal stability.

Polymeric VI improvers have been and are being used as bright stock replacement in the hope of improving lubricant film strength and lubrication and improving engine cleanliness. Dye may be used for identification purposes and to indicate whether a two-cycle fuel mix contains lubricant. Coupling agents are incorporated into some products to provide better component solubilities and improved fuel/lubricant mix water tolerance.

Anti-wear and lubricity improvers, particularly sulfurized sperm oil substitutes and other fatty acid and vegetable oils, such as castor oil, are used in special applications, such as racing and for very high fuel/lubricant ratios. Scavengers or combustion chamber deposit modifiers are sometimes used to promote better spark plug life and to remove carbon deposits. Halogenated compounds and/or phosphorous containing materials may be used for this application.

Rust and corrosion inhibitors of all types are and may be incorporated into two-cycle oil formulations. Odorants or deodorants are sometimes used for aesthetic reasons.

Lubricity agents such as synthetic polymers (e.g., polyisobutene having a number average molecular weight in the range of about 750 to about 15,000), as measured by vapor phase osmometry or gel permeation chromatography, polyol ether (e.g., poly(oxyethylene-oxypropylene)ethers) and ester oils (e.g., the ester oils described above) can also be used in the compositions of this invention. Natural oil fractions such as bright stocks (the relatively viscous products formed during conventional lubricating oil manufacture from petroleum) can also be used for this purpose. They are usually present in the two-cycle oil in the amount of about 3 to about 20% of the total oil composition.

As noted above the oils of this invention can also contain auxiliary detergent-dispersants. Typical examples are the amide, amine salt and/or amidine products formed by reaction of fatty acids of 5 to 22 carbon atoms (e.g., isostearic acid and mixtures of isostearic and stearic acid) with an alkylene polyamine of 2 to about 10 amino groups and 2 to 20 carbon atoms, such as ethylene diamine, diethylene triamine, triethylene tetramine, tetraethylene pentamine, etc., including commercially available mixtures of such alkylene polyamines. Such auxiliary detergent-dispersants are represented by those disclosed in U.S. Pat. No. 3,169,980 which is expressly incorporated herein by reference for such disclosure.

Diluents such as petroleum naphthas boiling at the range of about 38°–90° (e.g., Stoddard Solvent) can also be included in the oil compositions of this invention, typically in an amount of 5 to 25%.

An illustrative two-cycle engine oil lubricant composition contains 2–10% of one or more amino phenols described hereinbefore such as that described in Example 1B, and a base oil composed of about 70–80 parts by volume 650 neutral oil, 8–12 parts by volume bright stock and 10–20 parts by volume Stoddard Solvent.

In some two-cycle engines the lubricating oil may be injected into the combustion chamber along with the fuel or into the fuel just prior to the time the fuel enters the combustion chamber. The two-cycle lubricants of this invention are intended for use in such two-cycle engines.

As is well known to those skilled in the art, two-cycle engine lubricating oils can be added directly to the fuel to form a mixture of oil and fuel which is then introduced into the engine cylinder. Such lubricant-fuel oil mixtures are within the scope of this invention. Such lubricant-fuel blends generally contain per 1 part of oil about 15–250 parts fuel, typically they contain 1 part oil to about 50–100 parts fuel.

Typical specific examples of the two-cycle engine oils of this invention are the following:

| Component | Weight Percent | |
|---|---|---|
| | Example A | Example B |
| Base Oil[1] | 58.6 | 67.0 |
| Bright Stock[2] | 9.4 | 9.4 |
| Stoddard Solvent | 17.9 | 17.8 |
| Amino Phenol Additive 3[3] | 14.1 | — |
| Amino Phenol Additive 1[4] | — | 5.8 |

[1]A solvent-refined neutral oil having a viscosity of 650 SUS at 98.8° C.
[2]Having a viscosity of 150 SUS at 98.8° C.
[3]A mineral oil solution containing 60% of the amino phenol described in Example 3C
[4]A mineral oil solution containing 60% of the amino phenol described in Example 1B The fuels used in two-cycle engines are well known to those skilled in the art and usually contain a major portion of a normally liquid fuel such as hydrocarbonaceous petroleum distillate fuel (e.g., motor gasoline as defined by ASTM Specification D-439-73). Such fuels can also contain nonhydrocarbonaceous materials such as alcohols (especially with alkylene oxide polymers as lubricating oils, as disclosed hereinabove), ethers, organo-nitro compounds and the like (e.g., methanol, ethanol, diethyl ether, methyl ethyl ether, nitromethane) are also within the scope of this invention as are liquid fuels derived from vegetable or mineral sources such as corn, alfalfa, shale and coal. Examples of such fuel mixtures are combinations of gasoline and ethanol, diesel fuel and ether, gasoline and nitromethane, etc. Particularly preferred is gasoline, that is, a mixture of hydrocarbons having an ASTM boiling point of 60° C. at the 10% distillation point to about 205° C. at the 90% distillation point.

Two-cycle fuels also contain other additives which are well known to those of skill in the art. These can include anti-knock agents such as tetra-alkyl lead compounds, lead scavengers such as halo-alkanes (e.g., ethylene dichloride and ethylene dibromide), deposit preventors or modifiers such as triaryl phosphates, dyes, cetane improvers, anti-oxidants such as 2,6-di-tertiary-butyl-4-methylphenol, rust inhibitors, such as alkylated succinic acids and anhydrides, bacteriostatic agents, gum inhibitors, metal deactivators, demulsifiers, upper cylinder lubricants, anti-icing agents and the like.

What is claimed is:

1. A lubricant-fuel mixture for two-cycle engines comprising a major amount of a normally liquid fuel, a minor amount of at least one oil of lubricating viscosity and a minor amount, sufficient to control piston ring sticking and promote general engine cleanliness, of at least one compound of the formula

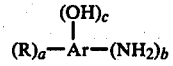

wherein R is a substantially saturated hydrocarbon-based substituent of at least about 30 aliphatic carbon atoms; a, b, and c are each independently an integer of one up to three times the number of aromatic nuclei present in Ar with the proviso that the sum of a, b, and c does not exceed the unsatisfied valences of Ar; and Ar is an aromatic moiety having 0 to 3 optional substituents selected from the group consisting of lower alkyl, lower alkoxy, nitro, halo, and combinations of two or more of said optional substituents; with the proviso that when Ar is a benzene nucleus having only one hydroxyl and one R substituent, the R substituent is para to said hydroxyl substituents.

2. A mixture as claimed in claim 1 wherein R has an average of up to about 400 aliphatic carbon atoms.

3. A mixture as claimed in claim 2 wherein R is a purely hydrocarbyl substituent.

4. A mixture as claimed in claim 3 wherein R is alkyl or alkenyl.

5. A mixture as claimed in claim 1 wherein Ar contains two or more linked and/or fused polynuclear aromatic nuclei.

6. A mixture as claimed in claim 5 wherein Ar is a naphthalene nucleus.

7. A mixture as claimed in claim 5 wherein the aromatic nucleus Ar corresponds to the formula

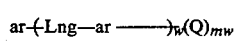

wherein ar is a single ring or fused ring nucleus of 4 to 10 carbons with the proviso that there are at least 3 unsatisfied valences in the total of all the ar's, w is an integer of 1 to 20 and each Lng is a bridging linkage individually chosen from the group consisting of carbon-to-carbon single bonds, either linkages (—O—), sulfide linkages (—S—), polysulfide linkages of 2 to 6 sulfur atoms ($—S_{2-6}—$), sulfinyl linkages, sulfonyl linkages, lower alkylene linkages, di(lower alkyl)methylene linkages, lower alkylene ether linkages, lower alkylene sulfide linkages, lower alkylene polysulfide linkages, amino linkages and mixtures of such bridging linkages, Q is a lower alkyl group, lower alkoxyl group, nitro group or halogen atom and m is 0 to 3.

8. A mixture as claimed in claim 1 wherein Ar is a benzene nucleus having 0 to 3 of said optional substituents and a, b, and c are each 1.

9. A mixture as claimed in claim 4 wherein R is derived from homopolymerized or interpolymerized $C_{2-10}$ olefins.

10. A mixture as claimed in claim 9 wherein said $C_{2-10}$ olefins are selected from the group consisting of $C_{2-10}$ 1-olefins and mixtures thereof.

11. A mixture as claimed in claim 10 wherein said 1-olefins are selected from the group consisting of ethylene, propylene, butylenes, and mixtures thereof.

12. A lubricant-fuel mixture for two-cycle engines comprising a major amount of a normally liquid fuel, a minor amount of at least one oil of lubricating viscosity and a minor amount, sufficient to control piston ring sticking and promote general engine cleanliness, of at least one compound of the formula

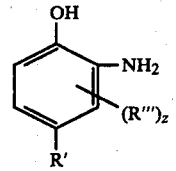

wherein R' is a substantially saturated hydrocarbon-based substituent having an average of from about 30 to about 400 aliphatic carbon atoms; R''' is a member selected from the group consisting of lower akyl, lower alkoxy, nitro, and halo; and z is 0 or 1.

13. A mixture as claimed in claim 12 wherein R' contains an average of at least about 50 aliphatic carbon atoms.

14. A mixture as claimed in claim 12 wherein R' is a substantially saturated purely aliphatic group.

15. A mixture as claimed in claim 14 wherein z is 0.

16. A mixture as claimed in claim 15 wherein R' is an alkyl or alkenyl substituent.

17. A mixture as claimed in claim 16 wherein R' contains an average of at least about 50 aliphatic carbon atoms.

18. A mixture as claimed in claim 12 wherein R' is a substituent derived from homopolymerized or interpolymerized $C_{2-10}$ olefins.

19. A mixture as claimed in claim 18 wherein said $C_{2-10}$ olefins are selected from the group consisting of $C_{2-10}$ 1-olefins and mixtures thereof.

20. A mixture as claimed in claim 19 wherein said 1-olefins are selected from the group consisting of ethylene, propylene, butylenes, and mixtures thereof.

21. A lubricant-fuel mixture for two-cycle engines comprising a major amount of a normally liquid fuel, a minor amount of at least one oil of lubricating viscosity and a minor amount, sufficient to control piston ring sticking and promote general engine cleanliness, of at least one compound of the formula

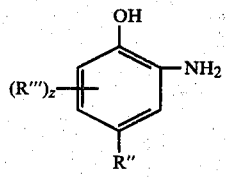

wherein R'' is derived from homopolymerized or interpol-merized $C_{2-10}$ 1-olefins and has an average of from about 30 to about 300 aliphatic carbon atoms; R''' is selected from the group consisting of lower alkyl, lower alkoxyl, nitro, and halo; and z is 0 or 1.

22. A mixture as claimed in claim 21 wherein said 1-olefins are selected from the group consisting of ethylene, propylene, butylenes, and mixtures thereof.

23. A mixture as claimed in claim 22 wherein R'' is derived from polymerized isobutene.

24. A mixture as claimed in claim 23 wherein z is 0.

25. A lubricant-fuel mixture for two-cycle engines comprising a major amount of a normally liquid fuel, a minor amount of at least one oil of lubricating viscosity and a minor amount, sufficient to control piston ring sticking and promote general engine cleanliness, of at least one amino-containing additive composition made by (I) nitrating with a nitrating agent at least one compound of the formula

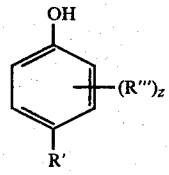

wherein R' is a substantially saturated hydrocarbon-based substituent having an average of from about 30 to about 400 aliphatic carbon atoms; R''' is a member selected from the group consisting of lower alkyl, lower alkoxyl, nitro, and halo; and z is 0 or 1, to form a first reaction mixture containing a nitro intermediate; and (II) reducing at least about 50% of the nitro groups in said first reaction mixture to amino groups.

26. A mixture as claimed in claim 25 wherein R' is derived from homopolymerized isobutene and z is 0.

27. A lubricant-fuel mixture for two-cycle engines comprising a major amount of a normally liquid fuel, a minor amount of at least one oil of lubricating viscosity and a minor amount, sufficient to control piston ring sticking and promote general cleanliness, of at least one amino-containing additive composition made by reducing at least about 50% of the nitro groups to amino groups in a nitro compound or mixture of compounds of the formula

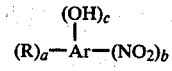

wherein R is a substantially saturated hydrocarbon-based substituent of at least about 30 aliphatic carbon atoms; a, b, and c are each independently an integer of one up to three times the number of aromatic nuclei present in Ar with the proviso that the sum of a, b, and c does not exceed the unsatisfied valences of Ar; and AR is an aromatic moiety having 0 to 3 optional substituents selected from the group consisting of lower alkyl, lower alkoxyl, halo, and combinations of two or more of said optional substituents; with the proviso that when Ar is a benzene nucleus having only one hydroxyl and one R substituent, the R substituent is para to said hydroxyl substituent.

28. A mixture according to claim 27 wherein the nitro compound or mixture of compounds is prepared by nitrating with at least one nitrating agent at least one compound having the formula

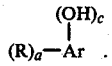

29. A mixture as claimed in claim 27 or 28 wherein the reducing agent is hydrogen in the presence of a metallic hydrogenation catalyst.

30. A mixture as claimed in claim 28 wherein R has an average of up to about 400 aliphatic carbon atoms.

31. A mixture as claimed in claim 28 wherein R has an average of up to about 300 carbon atoms.

32. A mixture as claimed in claim 31 wherein R is derived from homopolymerized or interpolymerized $C_{2-10}$ olefins.

33. A mixture as claimed in claim 32 wherein Ar' is a benzene nucleus.

34. A lubricant-fuel mixture for two-cycle engines comprising a major amount of a normally liquid fuel, a minor amount of at least one alkylene oxide polymer of lubricating viscosity and a minor amount, sufficient to control piston ring sticking and promote general engine cleanliness, of at least one compound of the formula

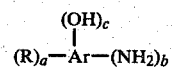

wherein R is a substantially saturated hydrocarbon-based substituent of at least about 10 aliphatic carbon atoms; a, b, and c are each independently an integer of one up to three times the number of aromatic nuclei present in Ar with the proviso that the sum of a, b, and c does not exceed the unsatisfied valences of Ar; and Ar is an aromatic moiety having 0 to 3 optional substituents selected from the group consisting of lower alkyl, lower alkoxyl, nitro, halo, and combinations of two or more of said optional substituents; with the proviso that when Ar is a benzene nucleus having only one hydroxyl and one R substituent, the R substituent is para to said hydroxyl substituent.

35. A mixture as claimed in claim 34 wherein R has an average of up to about 300 aliphatic carbon atoms.

36. A mixture as claimed in claim 35 wherein R is a purely hydrocarbyl substituent.

37. A mixture as claimed in claim 36 wherein R is alkyl or alkenyl.

38. A mixture as claimed in claim 34 wherein Ar is a benzene nucleus having 0 to 3 of said optional substituents and a, b, and c are each 1.

39. A mixture as claimed in claim 37 wherein R is derived from homopolymerized or interpolymerized $C_{2-10}$ olefins.

40. A mixture as claimed in claim 39 wherein said $C_{2-10}$ olefins are selected from the group consisting of $C_{2-10}$ 1-olefins and mixtures thereof.

41. A mixture as claimed in claim 40 wherein said 1-olefins are selected from the group consisting of ethylene, propylene, butylenes, and mixtures thereof.

42. A lubricant-fuel mixture for two-cycle engines comprising a major amount of a normally liquid fuel, a minor amount of at least one alkylene oxide polymer of lubricating viscosity and a minor amount, sufficient to control piston ring sticking and promote general engine cleanliness, of at least one compound of the formula

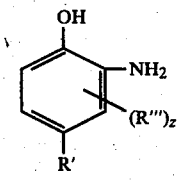

wherein R′ is a substantially saturated hydrocarbon-based substituent having an average of from about 10 to about 400 aliphatic carbon atoms; R''' is a member selected from the group consisting of lower alkyl, lower alkoxyl, nitro, and halo; and z is 0 to 1.

43. A mixture as claimed in claim 42 wherein R′ is a substantially saturated purely aliphatic group.

44. A mixture as claimed in claim 43 wherein z is 0.

45. A mixture as claimed in claim 44 wherein R′ is an alkyl or alkenyl substituent.

46. A mixture as claimed in claim 42 wherein R′ is a substituent derived from homopolymerized or interpolymerized $C_{2-10}$ olefins.

47. A mixture as claimed in claim 46 wherein said $C_{2-10}$ olefins are selected from the group consisting of $C_{2-10}$ 1-olefins and mixtures thereof.

48. A mixture as claimed in claim 47 wherein said 1-olefins are selected from the group consisting of ethylene, propylene, butylenes, and mixtures thereof.

49. A lubricant-fuel mixture for two-cycle engines comprising a major amount of a normally liquid fuel, a minor amount of at least one alkylene oxide polymer of lubricating viscosity and a minor amount, sufficient to control piston ring sticking and promote general engine cleanliness, of at least one compound of the formula

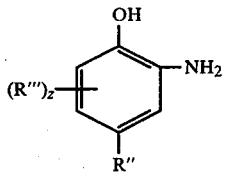

wherein R″ is derived from homopolymerized or interpolymerized $C_{2-10}$ 1-olefins and has an average of from about 10 to about 300 aliphatic carbon atoms; R''' is selected from the group consisting of lower alkyl, lower alkoxyl, nitro, and halo; and z is 0 or 1.

50. A mixture as claimed in claim 49 wherein said 1-olefins are selected from the group consisting of ethylene, propylene, butylenes, and mixtures thereof.

51. A mixture as claimed in claim 50 wherein R″ is derived from polymerized isobutene.

52. A mixture as claimed in claim 51 wherein z is 0.

53. A lubricant-fuel mixture for two-cycle engines comprising a major amount of a normally liquid fuel, a minor amount of at least one alkylene oxide polymer of lubricating viscosity and a minor amount, sufficient to control piston ring sticking and promote general engine cleanliness, of at least one amino-containing additive composition made by (I) nitrating with a nitrating agent at least one compound of the formula

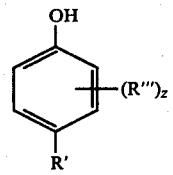

wherein R′ is a substantially saturated hydrocarbon-based substituent having an average of from about 10 to about 300 aliphatic carbon atoms; R''' is a member selected from the group consisting of lower alkyl, lower alkoxyl, nitro, and halo; and z is 0 or 1, to form a first reaction mixture containing a nitro intermediate; and (II) reducing at least about 50% of the nitro groups in said first reaction mixture to amine groups.

54. A mixture as claimed in claim 53 wherein R′ is derived from homopolymerized isobutene and z is 0.

55. A lubricant-fuel mixture for two-cycle engines comprising a major amount of a normally liquid fuel, a minor amount of at least one alkylene oxide polymer of lubricating viscosity and a minor amount, sufficient to control piston ring sticking and promote general engine cleanliness, of at least one amino-containing additive composition made by reducing at least about 50% of the nitro groups to amino groups in a nitro compound or mixture of compounds of the formula

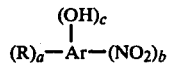

wherein R is a substantially saturated hydrocarbon-based substituent of at least about 10 aliphatic carbon atoms; a, b, and c are each independently an integer of one up to three times the number of aromatic nuclei present in Ar with the proviso that the sum of a, b, and c does not exceed the unsatisfied valences of Ar; and Ar is an aromatic moiety having 0 to 3 optional substituents selected from the group consisting of lower alkyl, lower alkoxyl, halo, and combinations of two or more of said optional substituents; with the proviso that when Ar is a benzene nucleus having only one hydroxyl and one R substituent, the R substituent is para to said hydroxyl substituent.

56. A mixture as claimed in claim 55 wherein the reducing agent is hydrogen in the presence of a metallic hydrogenation catalyst.

57. A mixture according to claim 55 wherein the nitro compound or mixture of compounds is prepared by nitrating with at least one nitrating agent at least one compound having the formula

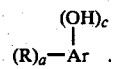

58. A mixture as claimed in claim 57 wherein R has an average of up to about 300 carbon atoms.

59. A mixture as claimed in claim 58 wherein R is derived from homopolymerized or interpolymerized $C_{2-10}$ olefins.

60. A mixture as claimed in claim 59 wherein Ar' is a benzene nucleus.

61. The mixture of claims 34, 37, 39, 41, 44, 46, 48, 51, 52, 53, 55, 57, 59 or 60 with about 15–250 parts of said fuel for every one part of said lubricant.

62. The mixture according to claim 61 wherein the fuel is an alkanol.

63. In a method for operating a two-cycle internal combustion engine, the improvement which comprises using a mixture as claimed in claims 34, 37, 39, 41, 42, 44, 46, 48, 51, 52, 53, 54, 55, 57, 59 or 60.

64. A mixture according to claim 1, 4, 9, 11, 12, 15, 18, 20, 23, 24, 32, 33, 25, 26, 27 or 28 wherein the oil of lubricating viscosity in a mineral oil.

65. The mixture of claims 1, 4, 9, 11, 12, 15, 18, 20, 23, 24, 32, 33, 25, 26, 27 or 28 with about 15–250 parts of said fuel for every one part of said lubricant.

66. The mixture of claim 64 with about 15–250 parts of said fuel by weight for every one part of said lubricant.

67. In a method of operating a two-cycle internal combustion engine, the improvement which comprises using a lubricant-fuel mixture as claimed in claims 1, 4, 9, 11, 12, 15, 18, 20, 23, 24, 32, 33, 25, 26, 27 or 28.

* * * * *